United States Patent [19]

Murphy

[11] 4,415,077

[45] * Nov. 15, 1983

[54] MODULAR MERCHANDISE DISPLAY TOWER

[76] Inventor: Thomas V. Murphy, Design Productions, P.O. Box 318, Oradell, N.J. 07649

[ * ] Notice: The portion of the term of this patent subsequent to Mar. 22, 2000 has been disclaimed.

[21] Appl. No.: 271,666

[22] Filed: Jun. 8, 1981

Related U.S. Application Data

[63] Continuation-in-part of Ser. No. 238,376, Feb. 26, 1981, Pat. No. 4,377,231.

[51] Int. Cl.[3] ..... B65D 3/24; A47F 1/04; A47F 3/14; B65D 5/50

[52] U.S. Cl. ..... 206/44 R; 206/45.34; 206/503; 206/821; 211/194; 211/195; 220/4 C; 248/174

[58] Field of Search ..... 206/44, 503, 821, 508, 206/509, 45.11, 44.12, 45.34; 220/4 C; 229/37, DIG. 11; 211/176, 194, 195; 248/174; 229/15, 21, 27

[56] References Cited

U.S. PATENT DOCUMENTS

| | | | |
|---|---|---|---|
| 1,120,296 | 12/1914 | Field | 229/15 |
| 1,126,274 | 1/1915 | Reynolds | 229/15 |
| 2,019,552 | 11/1935 | Watts | 229/21 |
| 2,089,084 | 8/1937 | Arneson | 229/21 |
| 2,129,488 | 9/1938 | Bomberger | 229/DIG. 11 |
| 2,283,406 | 5/1942 | Bacon | 248/174 |
| 2,353,160 | 9/1944 | Haack | 206/821 |
| 2,427,138 | 9/1947 | Hamilton et al. | 206/508 |
| 2,889,018 | 6/1959 | Swan | 220/22 |
| 2,957,601 | 10/1960 | Novick | 206/503 |
| 3,850,290 | 11/1974 | Murphy | 206/44 R |

FOREIGN PATENT DOCUMENTS

| | | | |
|---|---|---|---|
| 9509 | 4/1980 | European Pat. Off. | 220/4 C |

*Primary Examiner*—George E. Lowrance
*Assistant Examiner*—Jimmy G. Foster
*Attorney, Agent, or Firm*—Mandeville & Schweitzer

[57] ABSTRACT

The disclosure relates to a modular tower-like structure for displaying merchandise for point of purchase sale. In one form, the basic tower is formed of cylinders of a plastic sheet material, such as clear "rigid" die cut vinyl plastic, of a thickness enabling it to be collapsed into a relatively flat form for shipping and storage. The sheet plastic tower elements are given a rigid cylindrical form by means of molded plastic end rings, which are of a channel-like cross sectional configuration to lockingly receive the ends of the cylinders. The end rings are of a form and configuration enabling two of them to be bonded in back-to-back relation, providing a structural interlock between the top of one tower module and the bottom of a second tower module above it. In an alternate form, the lowermost tower element is formed of corrugated board, which has certain structural, practical, and economic advantages in the overall assembly. In any of its forms, the structure is simple, inexpensive, conveniently packaged and shipped, and easily assembled at the display site.

5 Claims, 13 Drawing Figures

FIG. 3
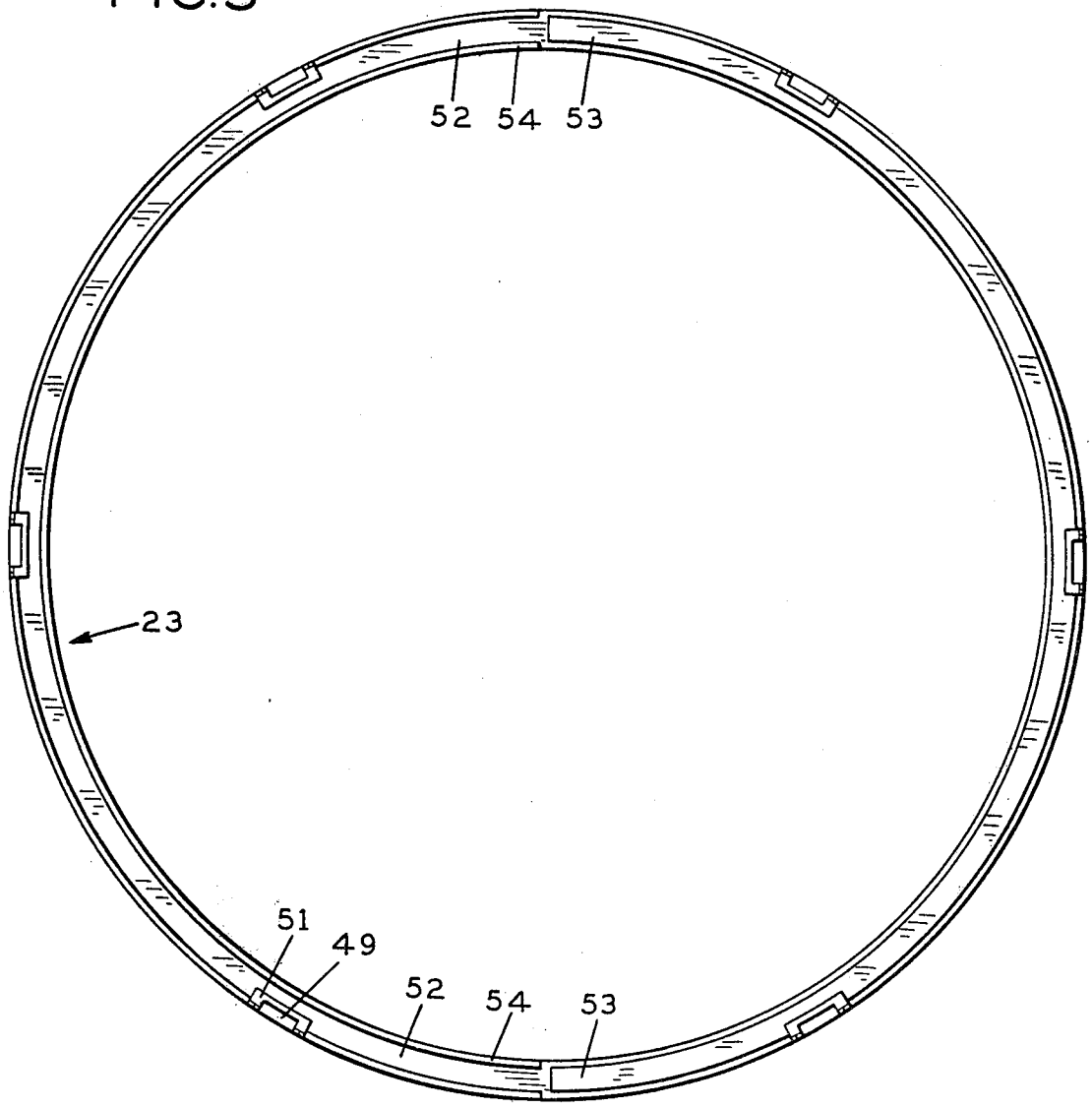
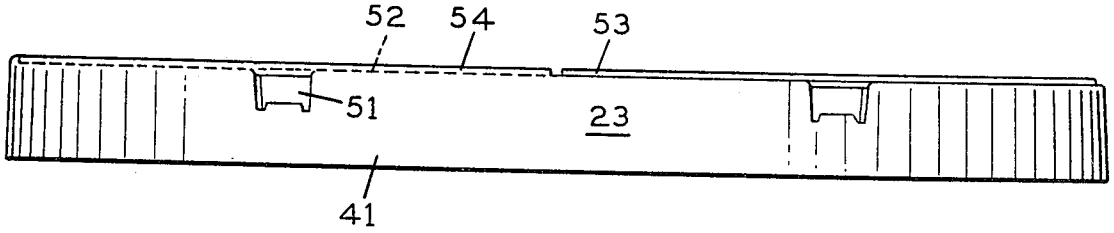
FIG. 5

MODULAR MERCHANDISE DISPLAY TOWER

RELATED APPLICATIONS

This application is a continuation-in-part of my copending application Ser. No. 238,376, filed Feb. 26, 1981, now U.S. Pat. No. 4,377,231, entitled MODULAR MERCHANDISE DISPLAY TOWER.

BACKGROUND AND SUMMARY OF THE INVENTION

In point of purchase merchandising, it is common for stores to set up special temporary displays of items of merchandise, in a location and manner of display to encourage impulse purchase. To this end, my earlier U.S. Pat. No. 3,850,290, is directed to a form of clear plastic tower, provided with an access opening at a convenient level and which is adapted to retain for display and dispensing a relatively large number of individual articles, such as bars of soap or the like. The display tower of the present invention is of the same general type and for the same general purpose as the display tower of my earlier patent. However, the tower structure of the present invention is of a modular construction and possesses somewhat greater strength and rigidity in its assembled form. The merchandiser is thus provided with somewhat greater flexibility in his use and application of the display tower.

In accordance with one of the specific aspects of the present invention, the tower is comprised of one or more cylindrical modular sections of a relatively thin, die cut clear vinyl. The vinyl, normally referred to as "rigid" vinyl, in fact has a reasonable degree of flexibility. It is die cut in flat form and then adhesively bonded at opposite ends to form a closed cylinder. The material has sufficient flexibility to be capable of being pressed relatively flat for boxing and shipping. For assembly and setup, the cylinder modules are shaped into a circular cross section, preferably, by means of circular, ring-like end elements, molded of a rigid plastic material, such as high impact styrene. A multi-story tower can be assembled by stacking cylinder modules one above the other, joined end to end by means of a connecting ring element.

In accordance with another specific aspect of the invention, the individual end rings and the intermediate connecting rings are formed on the same molded elements. The connecting rings, however, are comprised of a pair of the end rings joined back to back. In this respect, the invention provides for a unique and advantageous molded form of the end rings, so that a pair of such rings can be conveniently and expeditiously joined in back to back relationship to form a connecting ring unit.

In accordance with a further aspect of the invention, the lower cylinder module of a multi-story tower may advantageously be formed of vertically fluted corrugated board, while the upper section or sections are formed of clear plastic. The corrugated board provides enhanced stiffness, and a superior medium for printing display artwork, as well as certain production economies.

For a better understanding of the above and other features and advantages of the invention, reference should be made to the following detailed description of a preferred embodiment and to the accompanying drawings.

DESCRIPTION OF THE DRAWINGS

FIGS. 3, 4 and 5 are bottom plan, top plan and elevational views respectively of a molded connecting ring element constructed in accordance with the invention for capping the ends of the cylinder modules as well as joining modules one above the other.

DESCRIPTION OF PREFERRED EMBODIMENTS OF THE INVENTION

Figure 1:
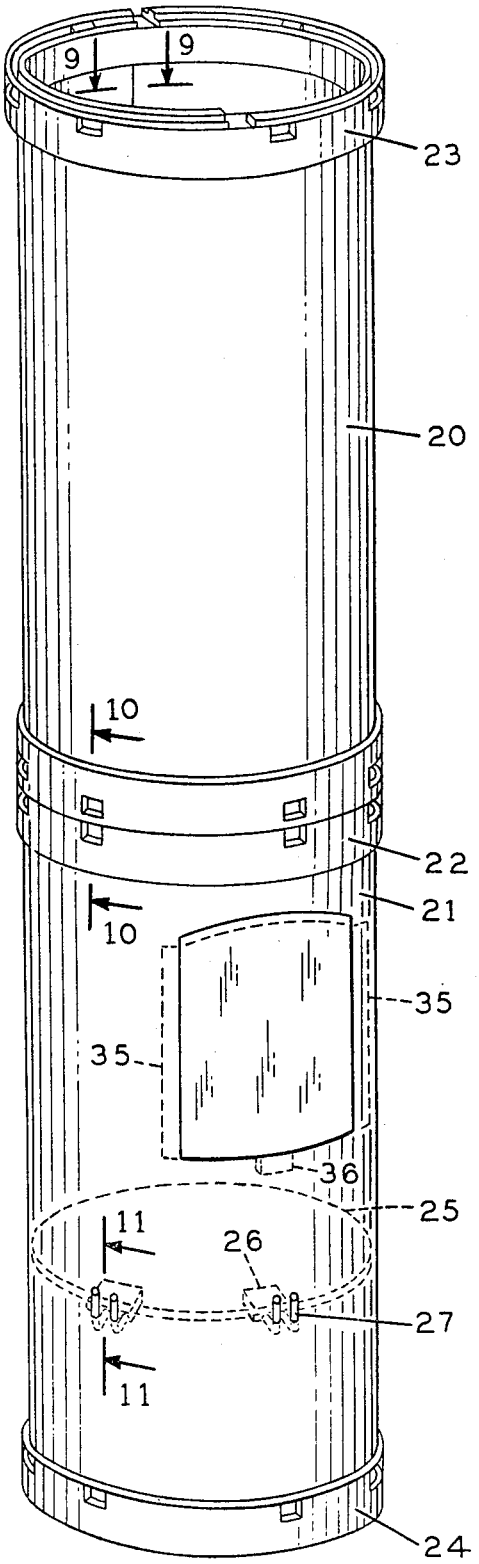
FIG. 1 is an elevational view in perspective of a multi-story modular display tower constructed in accordance with the invention.

Referring now to the drawings, and initially to FIGS. 1–12 thereof, illustrating a first embodiment, there is shown a two-story modular display tower, comprising upper and lower cylindrical tower modules 20, 21, arranged in aligned and abutted relation and joined together by means of a connecting ring unit 22. At the top and bottom, the tower modules 20, 21 are provided with circular end caps 23, 24 which, as will be hereinafter explained, are of identical construction but reversely oriented. At an appropriate level in the lower module 21 there is provided a circular bottom plate 25, which is supported by the walls of the lower tower module 21 and in turn provides a support for articles of merchandise contained within the multi-story tower. In the illustrated structure, the bottom plate 25 is supported by means of a plurality (three or more) of removable brackets 26, mounting lugs 27 of which are insertable through appropriately located apertures in the tower wall, much in the nature of so-called pegboard or panel board hooks.

Figure 2:
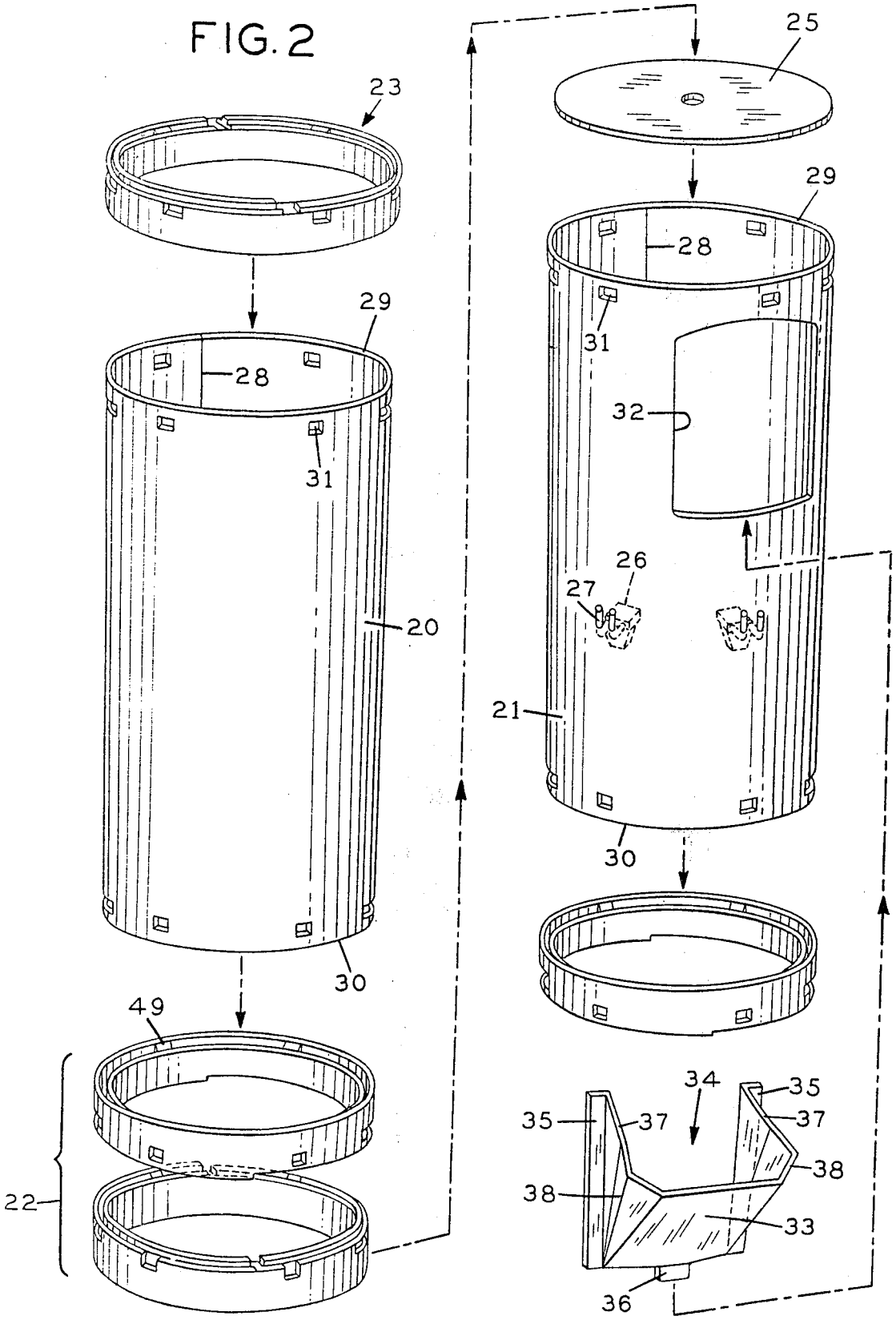
FIG. 2 is an exploded perspective view of the tower structure of FIG. 1.
Figure 4:
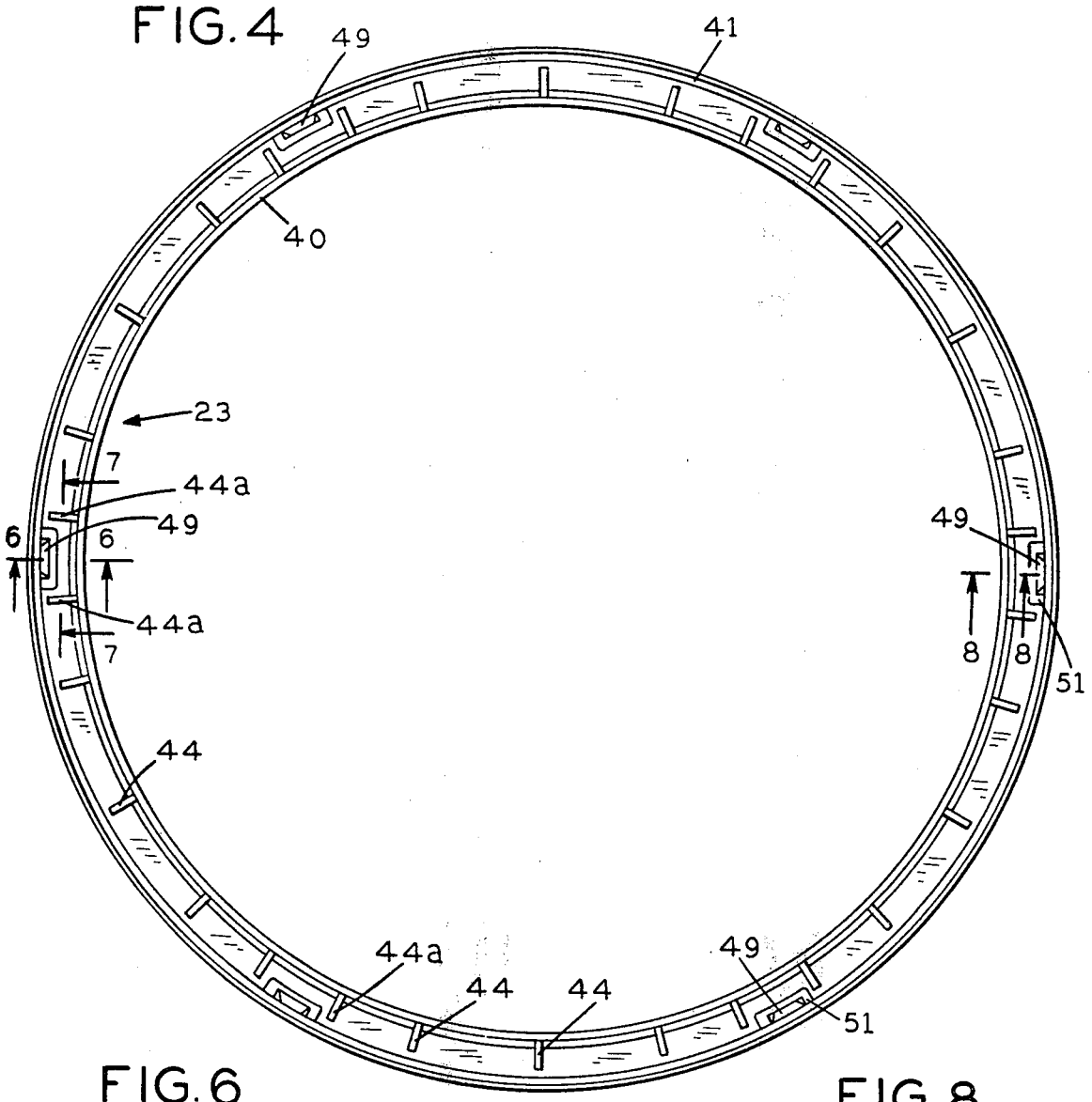
Figure 6:
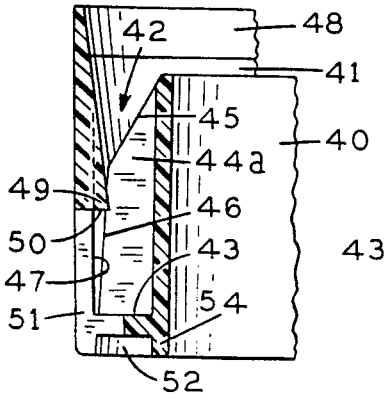
FIGS. 6, 7 and 8 are enlarged, fragmentary, cross sectional views as taken generally on lines 6—6, 7—7 and 8—8 respectively of FIG. 4.
Figure 7:
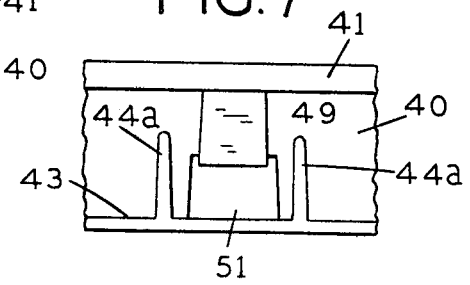
Figure 8:
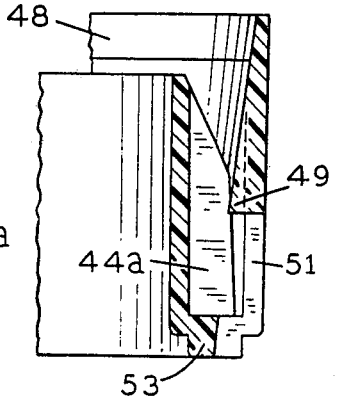
Figure 10:
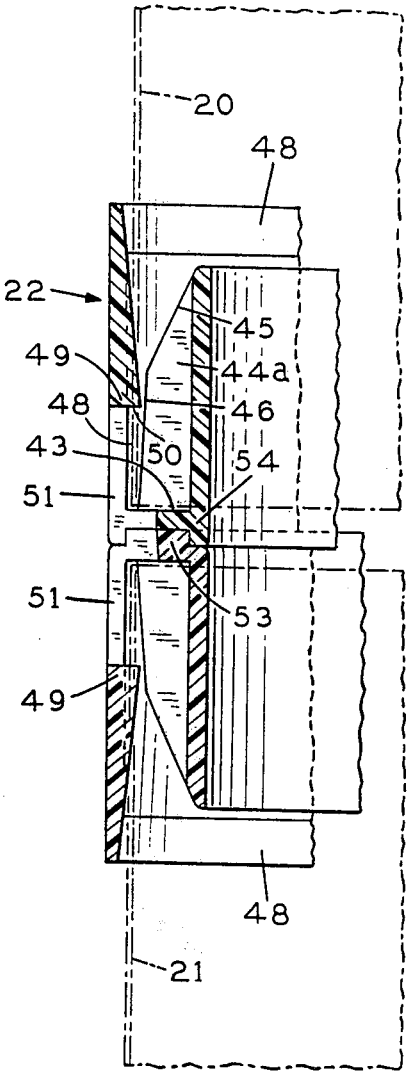
FIGS. 9, 10 and 11 are enlarged, fragmentary, cross sectional views taken generally on lines 9—9, 10—10 and 11—11 respectively of FIG. 1.
Figure 9:
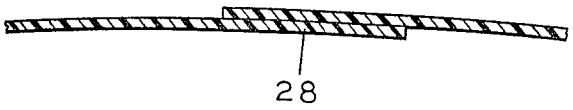

With reference to FIG. 2, the respective tower modules 20, 21 are formed of die cut rectangular sheets of so-called rigid vinyl plastic, overlapped slightly at the ends and bonded at 28, as reflected particularly in the detail of FIG. 9. In a typical unit according to the invention, the tower module is formed of a clear rigid vinyl of a thickness on the order of 0.040 inch. Adjacent the upper and lower end edges 29, 30, the tower modules are provided with circumferentially spaced rectangular cutouts 31 arranged for interlocking engagement with elements of the end rings 23, 24 and the central connecting ring structure 22, as will be described in further detail.

In a typical installation, the upper tower module 20 may have a more or less continuous sidewall for the retention of the articles to be merchandised. The lower tower module 21, on the other hand, is provided with an access cutout 32 of an appropriate size and shape to accommodate removal of the articles of merchandise to be displayed. A scoop 33 is mounted in the cutout opening 32 and, in normal use, projects outward from the tower wall providing free access through its exposed open area 34 (see FIG. 2). This permits free access to the articles for one at a time removal, while preventing uncontrolled gravity outflow. To advantage, the scoop 33 may be die cut or molded from a rigid or soft material and is provided with side flanges 35 and a bottom flange 36 arranged to be adhesively bonded to the inside walls of the lower module 21. The sidewalls 37 of the scoop are provided with upwardly and outwardly and outwardly radiating crease lines 38, providing a bellows-like structure to the sidewalls. This enables the scoop to be folded to a closed position, more or less flush with the outer wall of the tower module for shipping and storage, while enabling the scoop to be easily folded to an extended position, more or less as indicated in FIG. 2. With the display product bearing its weight upon the scoop during use, the scoop is of course held in its extended position as desired.

While specific dimensions are by no means critical to the invention, a typical practical embodiment of the invention may incorporate a pair of cylindrical tower modules 20, 21 approximately thirty-six inches in height, providing an assembled display tower of approximately six feet in overall height. The diameter of the cylinder modules and end rings may be on the order of eighteen inches, for example, in a representative unit, suitable for the display of relatively small articles of merchandise. Obviously, the principles of the invention apply equally well to towers of much larger, as well as smaller, dimensions.

With specific reference now to FIGS. 3–8, the cap rings 23, 24 desirably are injection molded of a suitably rigid plastic material, such as high impact polystyrene. The upper and lower caps, as well as the caps utilized for the connecting ring 22, are identical in form, and thus only the cap ring 23 will be described in detail. The ring 23 is of course of a diameter appropriate to the desired diameter of the cylinder modules 20, 21 and is provided with inner and outer cylindrical flange walls 40, 41 defining an annular channel 42 for the reception of an end margin of a cylindrical tower module. The two cylindrical flange walls 40, 41 are rigidly connected by a bottom wall 43.

Spaced about the inner wall 40 of the cap ring are a series of radially outwardly projecting vertical ribs 44, each provided with a rather sharply angled outer end surface 45 and a nearly vertical, but desirably slightly inclined surface 46 extending to the closed end of the annular channel 42. At the closed end extremity, the surface 46 is spaced slightly from the inner surface 47 of the outer cap wall, defining a relatively narrow slot for the reception of the sheet material forming the cylindrical tower modules.

Desirably, the diameter of the tower modules is approximately the same as the inside diameter of the outer cap wall 41 at the closed end of the channel 42. In this respect, the outer wall 41 advantageously angles outward at least slightly toward its open end, and is also advantageously tapered slightly at its outer extremity 48 to facilitate assembly of the cap ring onto the end of a tower module. As the tower module and ring are brought together, the end extremity of the cylinder is guided by the slightly angled and tapered outer ring wall 41 and by the angled rib surfaces 45, 46, so that the cylinder is easily brought into properly seated relation within the capping ring.

For releasably securing the capping rings to the cylindrical tower modules, tapered locking lugs 49 are formed on the outer walls 41 of the cap rings, and these lugs are arranged to be aligned with the die cut openings 31 in the cylinder walls. Thus, as the cap rings and tower cylinders are brought into assembled relation, the tower wall material is temporarily deflected inward by the tapered locking lugs 29 until the die cut openings 31 are opposite the lugs, whereupon the cylinder wall material deflects radially outward, underneath the end surfaces 50 of the lugs, whereupon the capping rings and cylinder modules are mechanically interlocked.

Desirably and to advantage, a pair of deflecting ribs **44*a* is positioned in closely straddling relation to each of the inwardly projecting locking lugs 49 so as to tend to urge the cylinder wall material outwardly on each side of the locking lug for secure and reliable locking. As is evident in FIG. 4, for example, a straddling pair of deflecting ribs 44*a* is spaced far enough from the side edges of the locking lug 49 to enable the cylinder wall material to be deflected around the locking lug without binding. To this end, in a typical embodiment of the invention, and noting that specific dimensions are not critical to the invention, the locking lugs 49 may have a width of, for example, 0.60 inch, whereas the adjacent straddling pair of deflecting ribs 44*a*** may be spaced approximately 1.12 inches apart.

In general, in a practical embodiment of the invention having the proportions previously mentioned, for example, approximately eighteen inches in diameter and approximately thirty-six inches in module height, there may be for example six locking lugs 49 spaced at about 60° intervals around the circumference of the capping ring. The deflecting ribs 44 may be spaced at intervals of approximately 15° except in the region of the locking lugs 49, where a straddling pair of such ribs **44*a*** is provided.

In order to provide for release of the interlocking connection between the capping ring and the cylinder module, the outer wall 41 of the capping ring is provided with an opening 51 immediately below each tapered locking lug 49. The opening 51 is of sufficient size to permit entry of a thumb or finger, or a small tool if necessary, to deflect the cylinder wall material inwardly to clear the locking lug and accommodate axial withdrawal of the assembled parts. The arrangement provides for a rigid, secure coupling of the capping rings to the cylinder modules with a minimum of fuss and efort, yet permits easy and expeditious disassembly of the parts as well.

In accordance with one of the important aspects of the invention, provision is made for interlockingly engaging in back-to-back relation a pair of identical capping rings 23, to provide a coupling ring 22 for rigidly securing together a pair of cylinder modules 20, 21 in end-to-end, axially aligned relation to provide a multistory tower structure as shown in FIG. 1. In general, all that is required is to bond together, in back-to-back, properly aligned relationship a pair of like capping ring elements. However, a simple yet advantageous arrangement is provided in the illustrated structure for compelling precise and proper axial alignment of an identical back-to-back pair of such connecting ring element. To this end, and as shown in detail in FIGS. 3, 6, 8 and 10, the structure of the capping ring 23 at its bottom or closed end is such as to form a tapered channel 52 over half of the circumference of the ring and a correspondingly tapered and dimensioned rib 53 extending over approximately the other half of the circumference of the ring. Whatever the proportioning and arranging of the respective channel and rib section 52, 53, they should be more or less equal and symmetrical such that an identical pair of rings may be assembled with the rib portion or portions of one of the rings being received in the channel portion or portions 52 of the ring, as is shown in the enlarged cross sectional view of FIG. 10. The tapered, interlocking relationship of the channel portions 52 and rib portions 53 assures that a back-to-back pair of cap rings is accurately aligned in axial relationship when thus assembled. Accordingly, in order to provide connecting ring structure, all that is required is to assemble a pair of like rings in the indicated, interfitting relationship and provide a bonding adhesive or solvent. With this arrangement, a single injection mold unit is all that is required to provide upper and lower end caps, as well as the intermediate connecting ring assemblies.

As will be understood and appreciated, the height of the channel forming walls 54 is the same as the height of the rib portions 53, such that the lower end capping ring element (e.g., item 24 of FIG. 1), rests in a level, square relationship with a supporting surface on which the structure is placed.

Figure 11:
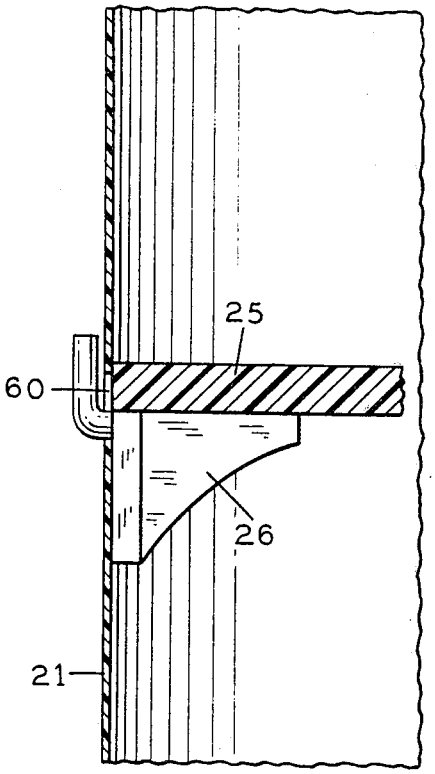

As reflected in the detail of FIG. 11, the circular bottom plate 25 is removably received within the erected lower tower module 21 by means of the support brackets 26. For convenience and economy, these may be in the form of commercially available component elements for pegboard hook assemblies, including pairs of L-shaped lugs 27 arranged to be received in appropriately located pairs of openings 60 provided at spaced intervals around the wall of the cylindrical module 21. If desired, sets of the lug-receiving openings 60 may be provided at a plurality of levels in the cylindrical unit 21, to accommodate adjustable positioning of the bottom panel 25.

Figures 12, 13:
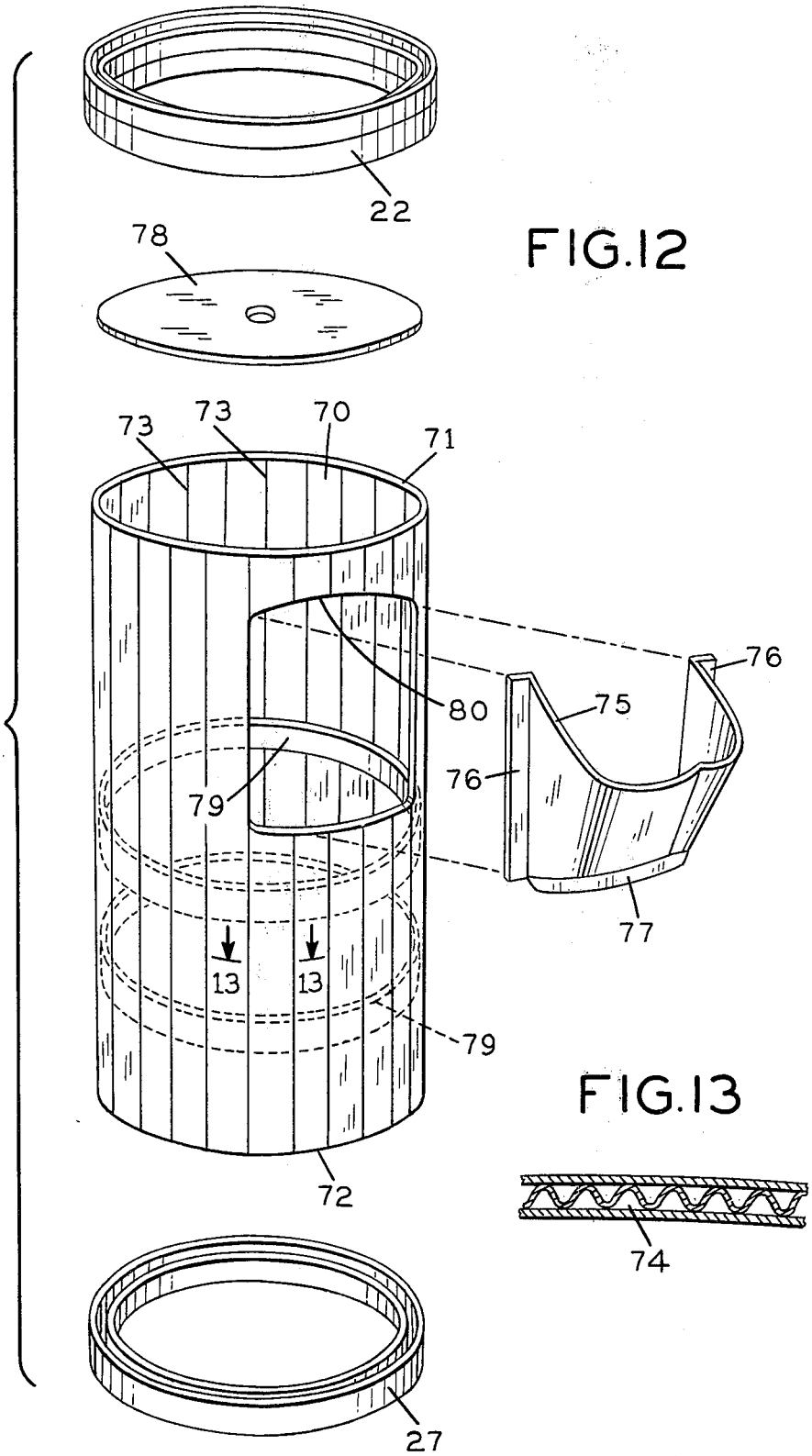
FIG. 12 is an exploded perspective view of the lower section of an alternative form of multi-story tower according to the invention.
FIG. 13 is an enlarged, fragmentary, cross sectional view taken generally on line 13—13 of FIG. 12.

Referring now to FIGS. 12 and 13, there is shown in part an advantageous modification of the multi-story display tower of the invention. The exploded, perspective view of FIG. 12 illustrates the bottom module only of the multi-story tower, and in this version of the invention, the lower cylinder module 70 is formed of a vertically fluted corrugated board material. Typically, the corrugated board is die cut in the form of a rectangular sheet, overlapped and adhesively secured at its opposite side edges to form a closed cylinder. Like the plastic material of the modification of FIGS. 1–11, the corrugated material of the tower module 70 may be compressed to a relatively flat condition for shipping, and then reformed to a circular, cylindrical configuration for assembly.

The upper end edge 71 of the corrugated tower module is arranged to be received in the lower half of the connecting ring 22, which may be identical to the connecting ring 22 illustrated in FIGS. 1–11. Likewise, the lower end edge 72 of the corrugated tower module is received in an end cap 24, which may be the same as the end cap 24 as described in connection with the previous embodiment.

The vertical flute orientation of the corrugated board 70 permits it to be bent or creased slightly above vertically oriented axes, in order to facilitate forming the board into the desired circular, cylindrical configuration. To this end, the board is pre-creased, lightly, every few inches around its entire circumference, as reflected by the plurality of crease lines 73 shown in FIG. 12, so that the material easily bends along designated lines.

The corrugated material utilized in the lower tower module 70 ideally is of a quality packaging grade, provided at least on the outside face, and preferably on both inside and outside faces, a relatively high quality display surface, such as a white surfacing sheet. This provides a desirable and attractive display surface for the printing of advertising or other display information. At the same time, the corrugated board material utilized in the lower tower module provides for opacity in that area, which is desirable because of some of the internal structure of the tower, which might otherwise detract from the display of the merchandise itself.

In a typical, practical form of the modification of FIGS. 12 and 13, the corrugated board material may have an overall thickness on the order of 0.120 inch, for example. This is somewhat greater than the space between the vertical ribs 44 of the plastic end caps, and the outer cylindrical flange walls of the cap rings, such that the ends of the corrugated tower module have to be wedged somewhat into the spaces opposite the vertical ribs. By way of example only, the spaces opposite the ribs 44 may, at the bottom, be as narrow as 0.050 inch, such that the end margins of the corrugated tower modules are crushed slightly in limited areas as they are inserted into the cap rings, to assure a snug friction fit, without, however, damaging the structural integrity of the corrugated module. Because of the relatively tight, friction fit of the corrugated material and the respective cap rings, it is neither necessary nor particularly desirable to provide for cut-out openings, as provided at 31, for example, in connection with the plastic tower modules.

In the embodiment of FIG. 12 or 13, there is provided a merchandise dispensing spout 75, which is in the form of a soft, flexible material, such as soft sheet vinyl, for example. Edge margins 76 and a bottom margin 77 of the spout are adhesively bonded to the inside wall of the corrugated tower module 70 to provide access to the merchandise contained therein. During shipping and storage, the flexible spout 75 may simply be pushed into the interior of the tower module 70.

With respect to support of the circular bottom plate 78, the arrangements of the embodiment of FIGS. 12, 13 are somewhat different from those of the first described embodiment. In particular, the interior of the tower module 70 is provided with shoulder-forming rings 79 at one or more levels, below the access opening 80. Typically and desirably, the shoulder-forming rings 79 are in the form of narrow strips of vertically fluted corrugated material, which are adhesively bonded to the interior surface of the tower module 70 at the desired locations. The vertically fluted material is readily flexible, to accommodate flattening of the tower module for shipping and storage. When the unit is assembled, the tower module 70 is opened up to circular form and the rigid bottom-forming panel 78 is inserted into the tower cylinder. The diameter of the bottom-forming panel 78 is, to a relatively close tolerance, the same as the internal diameter of the cylinder module 70 such that, when the bottom-forming panel 78 is at right angles to the cylinder axis, it cannot pass the shoulder-forming ring 79.

In order to support the bottom-forming panel 78 on one of the lower shoulder-forming rings 79, all that is necessary is to tilt the panel 78 slightly, allowing the cylinder module 70 to assume a slightly elliptical shape sufficient to pass the panel 78 through one or more upper level shoulder-forming rings 79 and into position above a lower ring 79.

The display tower structure of the invention provides an efficient system for point of purchase merchandise display and dispensing. The tower assembly packs into a relatively small container for shipping and storage, yet can be quickly and expeditiously assembled into a rigid, rugged attractive portable display facility. The design of the capping rings is such that a single, injection molded ring structure serves to provide both upper and lower end caps for the structure, as well as coupling means to join tower units in end-to-end relation.

The structure of the invention can be assembled in a variety of combinations, with all-plastic upper and lower tower modules, or with one or both of the modules being formed of vertically fluted corrugated material. Particularly advantageous, in this respect, is the combination of a clear plastic upper tower module, for attractive visual display of the product, and vertically fluted corrugated material for the lower tower module. The use of the corrugated material in the lower tower module has certain advantages over plastic, in that it provides a superior background for the printing of display artwork, which is of course an important consideration in the filed of display merchandising. The corrugated material also provides a somewhat stiffer structure, which can be advantageous with respect to the lower module in particular. At the same time, the corrugated material has a cost advantage over the plastic.

The utilization of rigid capping rings at the upper and lower ends of the tower modules provides for a high degree of structural integrity of the structure, by insuring retention of the desired circular, cross sectional configuration of the unit. Of particular importance in connection with the utilization of corrugated material for the lower module, the mounting of a plastic capping ring at the lower edge of the corrugated module effectively isolates the lower end edges of the corrugated material from the floor surface, so that the material is not stained and/or weakened by absorbing water during floor mopping, for example.

It should be understood, of course, that the specific forms of the invention herein illustrated and described are intended to be representative only, as certain changes may be made therein without departing from the clear teachings of the disclosure. By way of example but not of limitation, it may be desirable to provide a plurality of access openings in the tower modules, so that merchandise may be dispensed from more than one location on the structure. Likewise, it may be desirable to provide means for supporting more than one bottom plate on more than one level in the tower, with one or more access openings being provided in conjunction with each bottom plate; with such an arrangement, different types of merchandise may be segregated and dispensed from a single tower structure. The specific construction materials mentioned herein, while known to be desirable, are not to be considered as limiting. For example, the cylindrical tower modules may be formed of polyester or other sheet materials having dimensional stability and reasonable flexibility; likewise, the cap rings may be formed of other moldable materials, such as for example ABS. Accordingly, reference should be made to the following appended claims in determining the full scope of the invention.

I claim:

1. A multi-story tower structure for the display and dispensing of articles of merchandise which comprises (a) a plurality of cylindrical tower modules formed of sheet-like material having characteristics of substantial dimensional stability and at least limited flexibility, (b) a connecting ring having opposed oppositely directed axially opening annular recesses of short axial length in relation to the axial length of said tower modules, (c) a pair of said tower modules being received in said annular recesses to define a multi-story tower structure having a continuous tubular interior for the reception of display merchandise or the like, (d) generally circular bottom-forming means removably supported in one of said tower modules, (e) one of said tower modules having a merchandise access opening therein at a level above said bottom-forming means, (f) a merchandise dispensing spout extending outward and upward from said access opening to enable removal of display merchandise from said structure, (g) at least the lower one of said tower modules being formed of vertically fluted corrugated board, and (h) an annularly recessed ring element mounted at the lower end of said lower tower module and forming a capping ring.

2. A multi-story tower structure according to claim 1, further characterized by (a) said corrugated board being vertically creased at a multiplicity of circumferentially spaced locations to accommodate forming of the module into a cylinder of substantially circular cross section.

3. A multi-story tower structure according to claim 2, further characterized by (a) said lower tower module having one or more strip-like sections of vertically fluted corrugated board bonded to the interior wall thereof at one or more levels, and (b) said strip-like sections forming, when said lower module is in substantially circular configuration, a plurality of bottom-supporting shoulders.

4. A multi-story tower structure for the display and dispensing of articles of merchandise which comprises (a) a plurality of cylindrical tower modules formed of sheet-like material having characteristics of substantial dimensional stability and at least limited flexibility, (b) a connecting ring having opposed oppositely directed axially opening annular recesses of short axial length in relation to the axial length of said tower modules, (c) a pair of said tower modules being received in said annular recesses to define a multi-story tower structure having a continuous tubular interior for the reception of display merchandise or the like, (d) generally circular bottom-forming means removably supported in one of said tower modules, (e) one of said tower modules having a merchandise access opening therein at a level above said bottom-forming means, (f) a merchandise dispensing spout extending outward and upward from said access opening to enable removal of display merchandise from said structure, (g) at least the lower one of said tower modules being formed of vertically fluted corrugated board, and (h) said corrugated board being of a thickness slightly greater than said confined space, whereby said corrugated board is slightly wedged into assembled relation with said ring elements.

5. A multi-story tower structure for the display and dispensing of articles of merchandise which comprises (a) a plurality of cylindrical tower modules formed of sheet-like material having characteristics of substantial dimensional stability and at least limited flexibility, (b) a connecting ring having opposed oppositely directed axially opening annular recesses of short axial length in relation to the axial length of said tower modules, (c) a pair of said tower modules being received in said annular recesses to define a multi-story tower structure having a continuous tubular interior for the reception of display merchandise or the like, (d) generally circular bottom-forming means removably supported in one of said tower modules, (e) one of said tower modules having a merchandise access opening therein at a level above said bottom-forming means, (f) a merchandise dispensing spout extending outward and upward from said access opening to enable removal of display merchandise from said structure, (g) said merchandising dispensing spout being formed of sheet-like material and being formed to have an inclined outer wall, (h) said lower tower module being formed of corrugated board, and (i) said dispensing spout being formed of a soft, flexible material.

* * * * *